United States Patent [19]

van den Broek et al.

[11] Patent Number: 4,705,985

[45] Date of Patent: Nov. 10, 1987

[54] CATHODE-RAY TUBE AND ELECTRON GUN STRUCTURE THEREFOR

[75] Inventors: Martinus H. L. M. van den Broek; Jan D. Westra, both of Eindhoven, Netherlands

[73] Assignee: U.S. Philips Corporation, New York, N.Y.

[21] Appl. No.: 935,146

[22] Filed: Nov. 25, 1986

Related U.S. Application Data

[63] Continuation of Ser. No. 635,774, Jul. 30, 1984, abandoned.

[30] Foreign Application Priority Data

Aug. 4, 1983 [NL] Netherlands ..... 8302754

[51] Int. Cl.[4] ..... H01J 29/56; H01J 29/62

[52] U.S. Cl. ..... 313/449; 313/448

[58] Field of Search ..... 313/447, 448, 449

[56] References Cited

U.S. PATENT DOCUMENTS 2,887,600 5/1959 Fyler ..... 313/448

4,540,916 9/1985 Maruyama et al. ..... 313/449 X

*Primary Examiner*—Palmer C. DeMeo

*Attorney, Agent, or Firm*—Robert J. Kraus

[57] ABSTRACT

A cathode-ray tube comprising in an evacuated envelope a diode electron gun for generating an electron beam. The electron gun includes a cathode arranged on an axis with its emissive surface extending substantially perpendicularly to the axis, and an anode extending substantially perpendicularly to the axis and having an aperture opposite to the cathode, the electron beam being focused on a target by means of at least one focusing lens. The cathode-ray tube is a picture display tube, the target is a display screen, and the spacing between the anode and the cathode of the diode electron gun is smaller than 200 μm. The electron beam generated in the operating tube, viewed in the direction of propagation, is focused to form a cross-over immediately after the anode by a positive electron lens. The cross-over, which is displayed on the display screen by means of the focusing lens, has a current density on the axis which is larger than three times the current density in the point of intersection of the axis with the cathode. Because of this high current density crossover, a comparatively large electron beam current (1–5 mA) spot is formed on the display screen having a diameter which is smaller than the diameter of the spot formed by known cathode-ray display tubes having triode electron guns. The part of the anode including the aperture preferably consists of a thin metal foil which extends perpendicularly to the axis, and the thickness d of the foil divided by the radius r of the aperture is smaller than 1 ($^d/r<1$). Such a tube is particularly suitable for use as a projection television tube or a D.G.D.-tube.

8 Claims, 4 Drawing Figures

CATHODE-RAY TUBE AND ELECTRON GUN STRUCTURE THEREFOR

This is a continuation of application Ser. No. 635,774, filed 30 July 1984 now abandoned.

BACKGROUND OF THE INVENTION

The invention relates to a cathode-ray tube comprising, in an evacuated envelope, a diode electron gun for generating an electron beam. The electron gun comprises a cathode, which is arranged on an axis with its emissive surface extending substantially perpendicularly to the axis, and an anode extending substantially perpendicularly to the axis and having an aperture situated opposite to the cathode. The electron beam is focused on a target by means of at least one focusing lens.

Such a cathode-ray tube is known from U.S. Pat. No. 3,831,058 which discloses a television camera tube having a diode electron gun. Because no cross-over is formed in the electron beam produced by this gun, the beam current inertia is reduced due to the decrease of the interactions between the electrons. A part of the anode including an aperture having a radius of 0.01 mm is spaced from the cathode by 0.5 mm. The electron beam in a television camera tube is not modulated. The beam current in such a tube is a few to a few tens of micro-ampères.

Most of the known cathode-ray tubes for displaying pictures, such as colour and black-and-white display tubes, projection television display tubes, data graphic display (D.G.D.) tubes, and oscilloscope tubes, comprise a triode electron gun having a cathode, a negative grid and an anode. In such a triode electron gun a cross-over is formed between the cathode and the anode and is displayed on the display screen of the cathode-ray tube by means of one or more focusing lenses. The electron beam is modulated by a voltage variation at the cathode (cathode control) or at the negative grid (grid control). In such a triode electron gun the modulation and the electron beam formation are coupled. Upon forming the cross-over, aberrations are formed in the electron beam which result in an enlargement of the spot on the display screen. Such aberrations occur much less in a diode electron gun. However, for a number of reasons it is not possible to use the known diode electron gun in a picture display tube. As is known, the electron beam current in a picture display tube is much larger than in a television camera tube and, dependent on the type of tube, is 0.01–5 mA. With these electron beam currents the dissipation in the anode would become much too large. Moreover, without cross-over formation it is substantially impossible to adapt the beam aperture angle optimally to the main focusing lens.

SUMMARY OF THE INVENTION

It is therefore an object of the invention to provide a cathode-ray tube with which it is possible at comparatively large electron beam currents (1–5 mA) to obtain a spot on the display screen having a diameter which is smaller than the diameter of the spot in the known cathode-ray tubes having triode electron guns.

A cathode-ray tube of the kind described in the opening paragraph is characterized according to the invention in that the cathode-ray tube is a picture tube, the target is a display screen, the spacing between the anode, and the cathode of the diode electron gun is smaller than 200 μm and the electron beam generated in the operating tube viewed in its direction of propagation immediately after the anode is focused by a positive electron lens to form a cross-over: The cross-over is focused on the display screen by means of the focusing lens. The current density in the cross-over on the axis is larger than three times the current density in the point of intersection of the axis with the cathode.

The invention is based on the recognition of the fact that in the diode part of the gun substantially no spherical aberration is introduced into the electron beam. Focusing to form a cross-over can now occur by means of a lens having substantially no spherical aberration. As compared with the classical triode this presents advantages for currents exceeding 0.5 to 1 mA. The formation of a cross-over is of essential importance for adapting the electron beam to the properties of the main focusing lens of the diode electron gun. The properties of the positive electron lens for forming the cross-over may be varied as a function of the driving voltages so that the main focusing lens can have a fixed focal distance. The electron beam emerging from the aperture in the anode moreover has a rectangular current density distribution. At equal maximum cathode load this increases the brightness of the electron beam by approximately a factor 2.5 as compared with the brightness of the beam in a triode electron gun and this reduces the aberrations in the drift space between the main focusing lens and the display screen as a result of the space charge repelling.

By choosing the spacing between the cathode and the anode of the diode electron gun to be smaller than 200μm the anode dissipation is kept very small. In fact the dissipation D is proportional to a to the power 4/3, wherein a is the cathode-anode spacing. By using a restricted cathode area, for example, having a diameter which is not very much larger than the diameter of the aperture in the anode, the anode dissipation can be decreased even more. In the U.S. Pat. No. 3,831,058 which may be considered to be incorporated herein, no cross-over is formed and the current density at any point along the axis of the electron beam between the cathode and the anode is smaller than three times the current density in the point of intersection of the axis with the cathode. By using a positive electron lens after the diode part, a cross-over is formed in which the current density on the axis is larger than three times the current density in the point of intersection of the axis with the cathode. In principle the first grid is driven positively with respect to the cathode. The modulation voltage is only 20 to 40 Volts. The modulation voltage in triode electron guns is 100 to 200 Volts. This presents advantages in cathode-ray tubes in which the electron beam has to be modulated very rapidly.

A first preferred embodiment of the invention is characterised in that the part of the anode comprising the aperture consists of a thin metal foil extending perpendicularly to the axis and the thickness d of the foil divided by the radius r of the aperture is smaller than 1 ($^d/r<1$).

The thickness of the foil is preferably between 5 and 25 μm. A thickness of approximately 10 μm has proved to be particularly suitable. A suitable material for the manufacture of the foil is molybdenum. By choosing the foil to be so thin, only few electrons of the electron beam impact against the wall of the aperture in the anode. As a result of this, secondary emission having chromic aberration for its result is restricted. An additional advantage is that when a thin foil is used less lens action occurs in the aperture in the anode than when a thicker anode is used. Moreover, a spot is obtained having a still larger brightness because fewer electrons impact against the wall of the aperture.

A second preferred embodiment of the cathode-ray tube according to the invention is characterised in that at least one bar is present in or immediately in front of the aperture in the anode. For example, it is possible to use a system of cross-bars or a gauze. The function thereof is to restrict the so-called "Durchgriff" (penetration factor) of the other gun electrode. This is of essential importance in television display tubes to obtain a good driving characteristic. In tubes for displaying letters, digits, characters etc. (so-called D.G.D. tubes) such a structure is not necessary.

The invention is particularly suitable for being used as a projection television display tube or D.G.D. tube.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
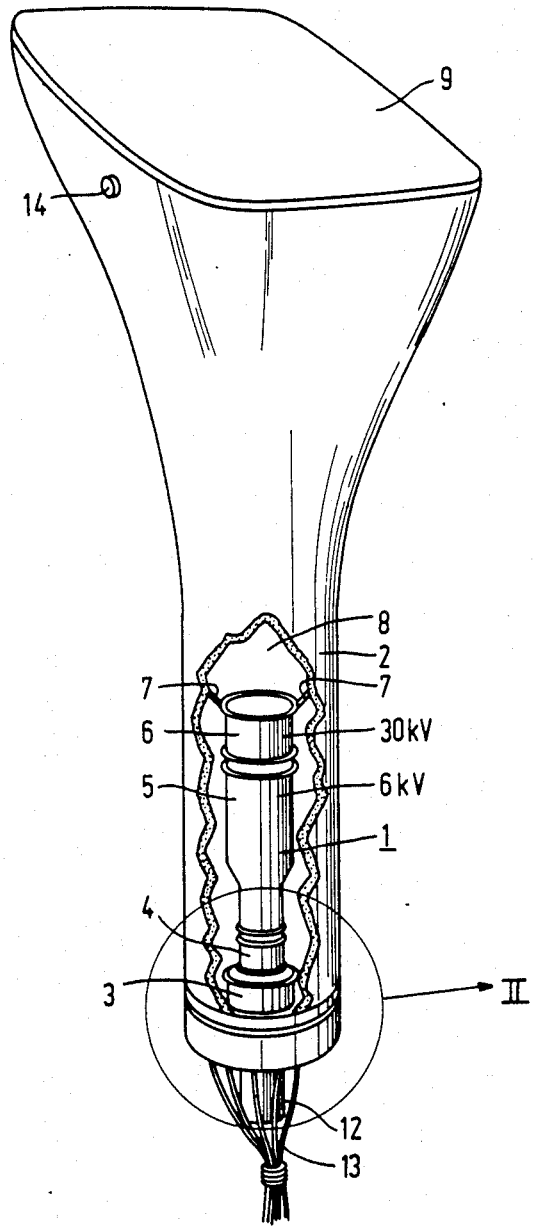
FIG. 1 is an elevation, partly broken away, of a projection television display tube.

FIG. 1 is an elevation, partly broken away, of a projection television display tube. The diode electron gun 1 is disposed in a glass tubular envelope 2. The diode electron gun is composed of a cathode (not visible), an anode 3, a first lens electrode 4, a second lens electrode 5 and a third lens electrode 6. The lens electrodes 5 and 6 together constitute the main focusing lens of the tube. It is, of course, also possible to use a magnetic main focusing lens.

Lens electrode 6 is connected to an electrically conductive coating 8 on the inner wall of the envelope 1 by means of contact springs 7. The electrodes of the diode electron gun are connected together in the usual manner by means of glass rods (now shown). One end of the tube is sealed by means of a display window 9 on the inside of which is provided a display screen on which the electron beam is focused to form a spot. The distance from the anode 3 to the display screen 9 is approximately 240 mm. For deflecting the electron beam over the display screen, two pairs of deflection coils around the tube envelope are used, or the tube comprises a set of deflection plates. The picture displayed on the display screen is projected on a projection screen by means of a system of mirrors or lenses.

The other end of the tube comprises an exhaust tube 12 to evacuate the tube and comprises electrical connections 13 for the cathode and the electrodes 3, 4 and 5. Electrode 6 can be brought to the desired potential via the high-voltage contact 14, the conductive coating 8 and the contact springs 7.

Figure 2:
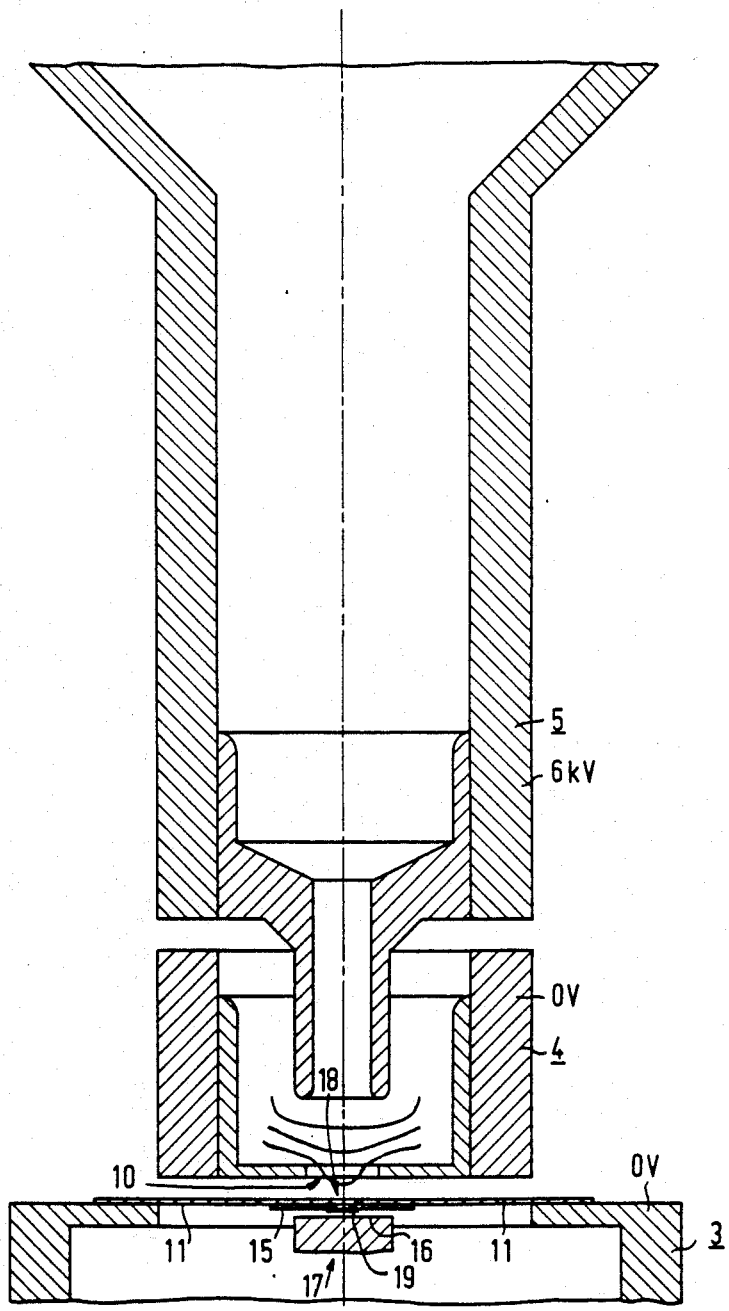
FIG. 2 is a longitudinal sectional view of a detail of the diode electron gun of the projection television display tube shown in FIG. 1.

FIG. 2 is a longitudinal sectional view of a detail of the diode electron gun of the tube shown in FIG. 1. Anode 3 comprises an 8 μm thick molybdenum foil 15 which is connected against a 100 μm thick carrier foil 11 of molybdenum. Opposite to the emissive surface 16 of cathode 17 an aperture 18 having a diameter of 250 μm is provided in the foil 15. The distance between the cathode surface 16 and the foil 15 is approximately 48 μm. A system of cross-bars 19 having a bar thickness of approximately 14 μm is provided against the foil over aperture 18. The potentials at the electrodes are indicated in the Figures. A positive electron lens is formed between electrode 4 and electrode 5 and focuses the electron beam passing through the aperture 18 in the anode 3 to form a cross-over. A few equipotential lines of the lens field are shown in aperture 10 in electrode 4 and between the electrodes 4 and 5. The cross-over thus formed is then focused on the display screen to form a spot by means of the main focusing lens. In a tube according to the invention the spot has, for example, a diameter of approximately 300 μm, as compared to known tubes in which the spot has a diameter of 600 μm to 7 mm. Modulation of the electron beam is carried out by driving the cathode between −25 and +5 Volts relative to the anode. The illustrated construction of the electrodes 4 and 5 as each having two parts is not essential. What is essential is that the anode 3 is succeeded by a positive lens which focuses the electron beam to a cross-over. It is recommended that the field strengths on both sides of the foil 15 be substantially equal to each other.

Figure 3:
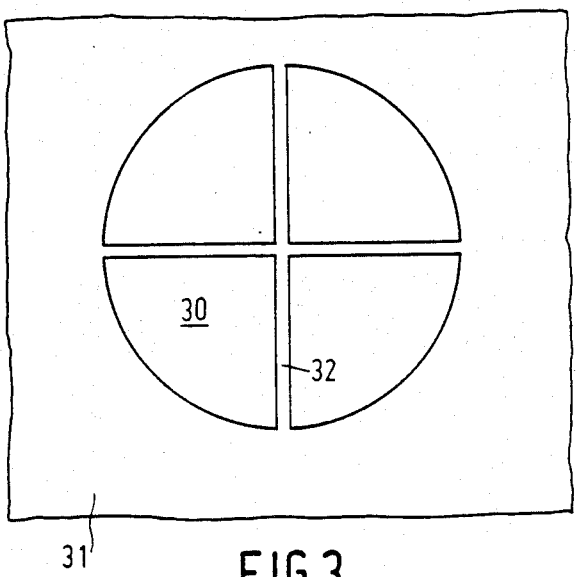
FIG. 3 is an elevation of an anode aperture.

FIG. 3 shows an aperture 30 in a foil 31 for an anode for a cathode-ray tube according to the invention. The foil has a thickness of 10 μm. The aperture has a diameter of 250 μm and is produced by means of an etching process or micro-spark erosion in which a system of cross-bars 32 each having a width of 8 μm is formed in the aperture.

Figure 4:
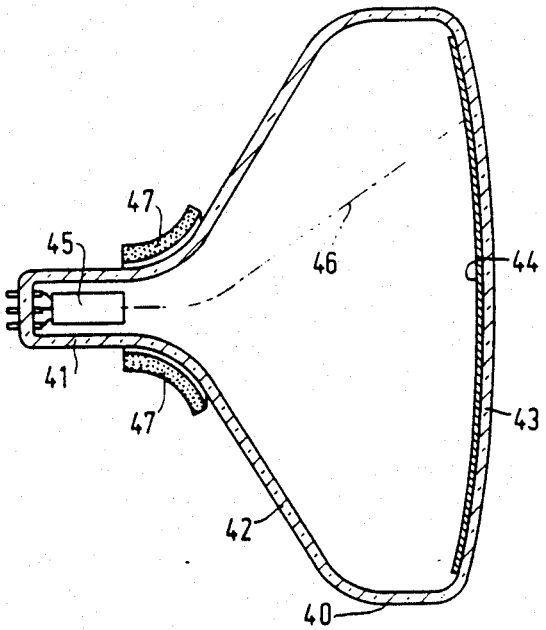
FIG. 4 is a longitudinal sectional view of a display tube for displaying letters, digits, characters, and/or figures (a D.G.D. tube).

FIG. 4 is a longitudinal sectional view of a D.G.D.-tube. The glass envelope 40 of the tube consists of a neck 41, a cone 42 and a display window 43 which comprises a display screen 44 on its inside. An electron gun 45, as shown in FIG. 2, but without a system of cross-bars is disposed in the neck 41. The generated electron beam 46 is focused on the display screen 44 and is deflected by means of deflection coils 47.

What is claimed is:

1. A cathode ray display tube comprising an envelope including a display window supporting a luminescent screen and containing means for producing a modulated electron beam directed at said screen, characterized in that said electron beam producing means comprises a diode electron gun for producing an electron beam having a current of at least 0.5 milliampere, said gun comprising, arranged in succession along an axis on which the electron beam is produced:

(a) a cathode for emitting electrons;

(b) an anode including:

(1) an apertured anode place spaced from the cathode by a distance less than 200 μm for cooperating with the cathode to form emitted electrons into a beam having a rectangular current density distribution, the thickness of said plate being smaller than one-half of the width of the aperture in the plate; and (2) an electron-permeable field-shielding means extending across the aperture in said plate;

(c) first and second lens electrodes having respective apertures for passing the electron beam, said electrodes being shaped to form therebetween a positive electron lens for focusing the beam into a cross-over; and (d) means for producing a main focusing electron lens for focusing the cross-over to a spot having a diameter less than 600 μm on the luminescent screen.

2. A cathode ray tube as in claim 1 where said plate comprises a metallic foil extending perpendicularly to the axis.

3. A cathode ray tube as in claim 2 where the metallic foil has a thickness between 5 and 25 μm.

4. A cathode ray tube as in claim 3 where the metallic foil has a thickness of approximately 10 μm.

5. A cathode ray tube as in claim 2, 3 or 4 where the metallic foil consists essentially of molybdenum.

6. A cathode ray tube as in claim 1, 2, 3 or 4 where said field-shielding means comprises first and second metallic bars extending across said aperture at right angles to each other.

7. A cathode ray tube as in claim 1, 2, 3 or 4 where said tube comprises a projection television tube.

8. A cathode ray tube as in claim 1, 2, 3 or 4 where said tube comprises a data graphic display tube.

* * * * *